United States Patent [19]

Gaudreau, Jr.

[11] Patent Number: 4,712,788

[45] Date of Patent: Dec. 15, 1987

[54] AQUATIC EXERCISE APPARATUS

[76] Inventor: Charles H. Gaudreau, Jr., 2736 Octavia St., New Orleans, La. 70115

[21] Appl. No.: 916,888

[22] Filed: Oct. 8, 1986

[51] Int. Cl.[4] ..... A63B 23/06

[52] U.S. Cl. ..... 272/69; 4/563

[58] Field of Search ..... 272/69; 4/563, 564

[56] References Cited

U.S. PATENT DOCUMENTS

| | | | |
|---|---|---|---|
| 3,193,287 | 7/1965 | Robinson | 272/69 |
| 3,485,213 | 12/1969 | Scanlon | 272/69 X |
| 4,183,106 | 1/1980 | Grimes et al. | 4/563 X |
| 4,221,008 | 9/1980 | Nolan | 4/563 X |
| 4,283,803 | 8/1981 | Krumbeck | 4/496 |
| 4,332,217 | 6/1982 | Davis | 272/69 X |
| 4,576,376 | 3/1986 | Miller | 272/69 |

*Primary Examiner*—Andrew V. Kundrat

*Attorney, Agent, or Firm*—Keaty & Keaty

[57] ABSTRACT

An aquatic exercise apparatus comprises a platform having an exercise device, preferably a treadmill, disposed therein. The apparatus mounts at the edge of a body of water, and is movable between a first position in which the platform is at the level of a surface adjacent the body of water and positions below the first position, including positions in which the platform is submerged in the water. An exerciser in a wheechair can wheel onto the platform is in its first position. He then lowers the platform to a depth at which adequate buoyant support is provided and begins exercising. When finished, he gets back into his wheelchair, raises the platform to its first position and exits the platform. The apparatus can also be used by non-wheelchair-bound individuals.

18 Claims, 5 Drawing Figures

AQUATIC EXERCISE APPARATUS

BACKGROUND OF THE INVENTION

1. Field of the Invention

The present invention relates to an exercise apparatus, and more particularly to an aquatic exercise apparatus which helps healthy persons remain physically fit and can aid in the rehabilitation of disabled persons.

2. General Background of the Invention

It has long been recognized that exercising is important to promote and maintain good health, and can aid in the rehabilitation of disabled persons. The most common types of exercise comprise physical activity on dry land; however, it is well known that exercising in water can, in many respects, be more advantageous. For some persons, aquatic exercise may be the only practical option available. Such persons include those who, due to automobile accidents or bouts with polio, for example, have restricted or non-existent control over their lower limbs. Other such persons include those who, while they may have excellent leg strength and control, have limited control over their trunk, and are unable to sit or stand upright without support. Water provides buoyant support for their bodies, enabling them to exercise their arms and, depending upon the severity of their condition, their legs by swimming. The majority of these individuals have a difficult time entering the water through means which most of us take for granted (for example, walking into a swimming pool on steps). Accordingly, various devices have been proposed to facilitate their entry into and exit from bodies of water.

U.S. Pat. No. 4,183,106, for example, discloses a device which comprises a chair on which a disabled person sits. The chair swivels between a position above a deck near a swimming pool and a position above the pool. Means are provided to lower the chair into the pool, thereby allowing the person easy access to the pool.

U.S. Pat. No. 4,221,008 discloses a hydraulic chair lift, similar to that described above, which uses domestic water pressure for operation.

U.S. Pat. No. 4,283,803 describes a hydraulically-operated wheelchair submersion device which utilizes water as the hydraulic fluid. A wheelchair is wheeled onto a platform, which lowers into a swimming pool, allowing a disabled individual to easily enter the pool.

Conventional aquatic exercise, such as swimming, is not the only useful type of aquatic exercise. In recent years, athletic trainers and physical therapists have found that many forms of exercise, which have traditionally been performed only on dry land, can be even more beneficial when carried out in water. In fact, due to various injuries sustained or disorders suffered, some individuals, temporarily or permanently, can safely perform certain traditionally land-based exercise, such as running or walking, only in water. This is because the buoyancy of the water helps to reduce the stress on an individual as he exercises. The force at heal strike on a runner's foot on level ground is three times his body weight; each of his feet strike the ground approximately one thousand times per mile. A 150 pound runner therefore applies about 120 tons of pressure to each foot each mile. This is a tremendous amount of stress on the body, and helps explain why most athletes suffer from running injuries at one time or another. For runners susceptible to stress fractures, the ability to exercise without subjecting his body to such punishing stress is a desirable alternative which aquatic exercise can provide. Even excessive walking on land can be disadvantageous for some people, since each leg spends about 60% of the time in the stressful stance phase in which the foot contacts the ground. Other individuals who can benefit from aquatic exercise include obese persons who find it too difficult to ambulate much on land due to the burden of their weight, persons suffering from neuromuscular disorders whose leg muscles can move but are not yet trained to support the person's weight, post-operative patients who need to slowly build up strength in their legs and individuals with limited control over their upper bodies.

Various devices and systems have been proposed which could assist some of these individuals in exercising. U.S. Pat. No. 4,551,108, for example, discloses a system for exercising in water which comprises a buoyant vest and a plurality of lines. The exerciser wears the buoyant vest in a tank of water, and the lines interconnect the vest and the sides of the tank. The vest provides some buoyant support, the lines help to keep the exerciser's head above water and keep his feet above the bottom of the tank. The exerciser can thus run in place in the water, without subjecting his legs to stress or relying on his legs to support his weight. While this system can be helpful for some people, others, particularly those confined to wheelchairs, may have difficulty entering the tank and adjusting the lines to the proper length.

Another system which has been proposed is an animal exercising device disclosed in U.S. Pat. No. 4,332,217. The device comprises a portable water tank with a treadmill in the bottom thereof. In operation, an animal enters the tank and the tank is filled with water. The buoyancy of the animal's body reduces the stress on his legs while he exercises on the treadmill. The exercise sessions are repeated, each time with less water in the tank as the animal's legs are able to bear more weight. Eventually, no water is necessary in the tank. While this device can be useful to aid some people in performing aquatic exercise, it is large and relatively expensive, uses a large quantity of water, and some individuals would find it difficult to enter the tank. Furthermore, varying the level of water in the tank is a time-consuming process.

SUMMARY OF THE INVENTION

The present invention provides an apparatus which allows an aquatic exerciser easy access to a body of water as well as a means to exercise in the water.

The present invention comprises an aquatic exercise apparatus which mounts at the edge of a body of water. The apparatus comprises a platform means and vertical movement means to move the platform means between a first position at the level of a surface adjacent the body of water, and positions in which the platform is below the first position, including positions in which the platform is submersed in the body of water. An exercise device, preferably a treadmill, is disposed on the platform means. Treadmills are popular exercise devices, as walking is such a natural form of exercise which most people can perform. Exercising on a treadmill provides a workout for the entire body, helps to exercise the leg muscles, to tone the upper body, to tighten stomach muscles, to increase circulation and to burn calories. The exercise device could also comprise, for example, a stationary cycle, a rowing machine, rollers, or some other type of stationary exercise device; the choice of a particular exercise device depends on the type of conditioning and workout which would be most helpful for the exerciser.

An exerciser in a wheelchair wheels onto the platform means when it is in its first position. The platform means is lowered into the water until the water provides adequate buoyant support for the exerciser to maintain himself in an upright position (in the case of an individual with limited trunk control or weak legs) or until the water provides enough buoyant support so that the exerciser can stand without subjecting his legs to too much stress (in the case of an individual susceptible to stress fractures). The exerciser then begins exercising using the exercise device. When the exercise session is over, he sits in his wheelchair, and the platform means is brought back to the first position so he can wheel off of the platform means.

The variable positioning of the platform means allows the exerciser to select the amount of buoyant support provided by the water to correspond to his needs.

The exercise device is preferably adjustable to allow the exerciser to select the level of difficulty of exercise which he desires.

The vertical movement means is preferably hydraulically operated using domestic water pressure. Hydraulic operation is preferable to electrical operation in the wet environment around a body of water. By using water as the hydraulic fluid, there is no danger of hydraulic fluid contaminating the body of water. Using domestic water pressure as the driving force obviates the need for auxiliary pumps.

It is an object of the present invention to provide an aquatic exercise apparatus which allows an exerciser easy access to a body of water.

It is also an object of the present invention to provide an aquatic exercise apparatus with means to enable a user to exercise in an upright position in the water.

A further object of the present invention is to provide an aquatic exercise apparatus with means to vary the amount of buoyant support provided an exerciser.

Yet another object of the present invention is to provide an aquatic exercise apparatus with means to vary the level of difficulty of the exercise.

BRIEF DESCRIPTION OF THE DRAWINGS

For a better understanding of the objects and advantages of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
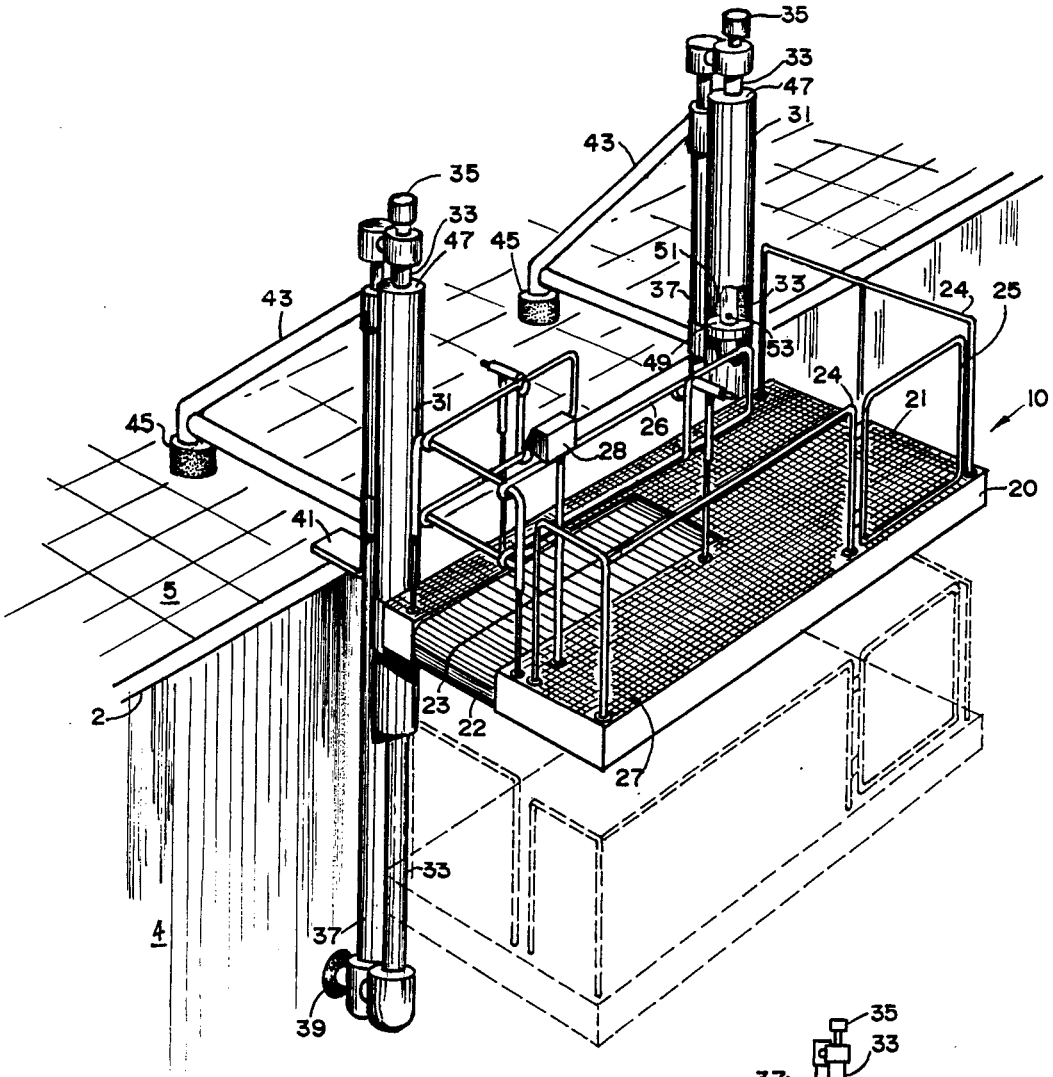
FIG. 1 is a perspective, partially cut-away view of the preferred embodiment of the aquatic exercise apparatus of the present invention.
Figure 2:
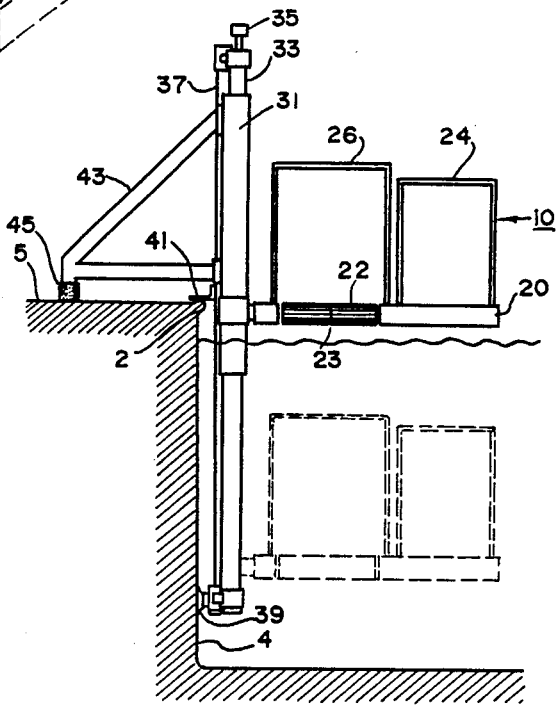
FIG. 2 is a side view of the apparatus shown in FIG. 1.
Figure 3:
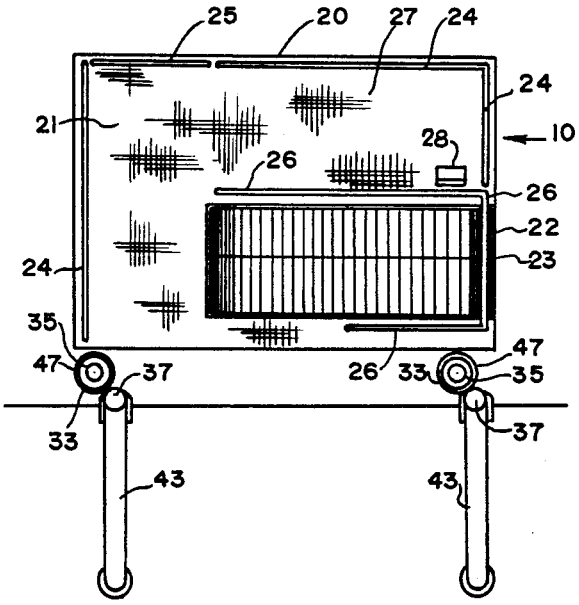
FIG. 3 is a top view of the apparatus shown in FIG. 1.

Referring now to the drawings, the preferred embodiment of the present invention comprises a portable aquatic exercise apparatus 10 which may be mounted adjacent a body of water. Aquatic exercise apparatus 10 comprises a platform 20 securely attached to cylinders 31. Cylinders 31 are disposed on vertical piston members 33, which have hose couplings 35 attached at upper ends thereof. Hose couplings 35 serve to allow a hose (not shown) to be attached to vertical piston members 33 to provide fluid communication between the interior of vertical piston members 33 and a source of pressurized hydraulic fluid (preferably water), which is used to control the vertical positioning of platform 20. An annular disc member 47 (FIGS. 1 and 3) is securely attached in fluid-sealing engagement, to an end of each cylinder 31, and is in sliding yet fluid-sealing relationship with vertical piston member 33. An annular disc member 49 (see FIG. 1) is securely attached in fluid-sealing engagement to each vertical piston member 33, and is in sliding yet fluid-sealing relationship with cylinder 31. Annular disc members 47 and 49 define the upper and lower limits, respectively, of a variable-volume fluid-receiving region 51 between vertical piston member 33 and cylinder 31. An opening 53 in vertical piston member 33 allows fluid communication between the interior of vertical piston member 33 and variable-volume fluid-receiving region 51. Vertical piston members 33 are connected at their upper and lower ends to vertical standards 37, which function to secure aquatic exercise device 10 adjacent an edge of a body of water, such as a swimming pool. Each vertical standard 37 has a lower securing means, such as a suction cup 39 projecting from a lower end thereof, to attach it to a wall of a pool or a leg of a wharf, and upper securing means. The upper securing means comprises an L-shaped bar member 41 (best seen in FIG. 2) and a support member 43 projecting from vertical standard 37; a non-skid member 45 projects downwardly from an end of support member 43.

Figure 5:
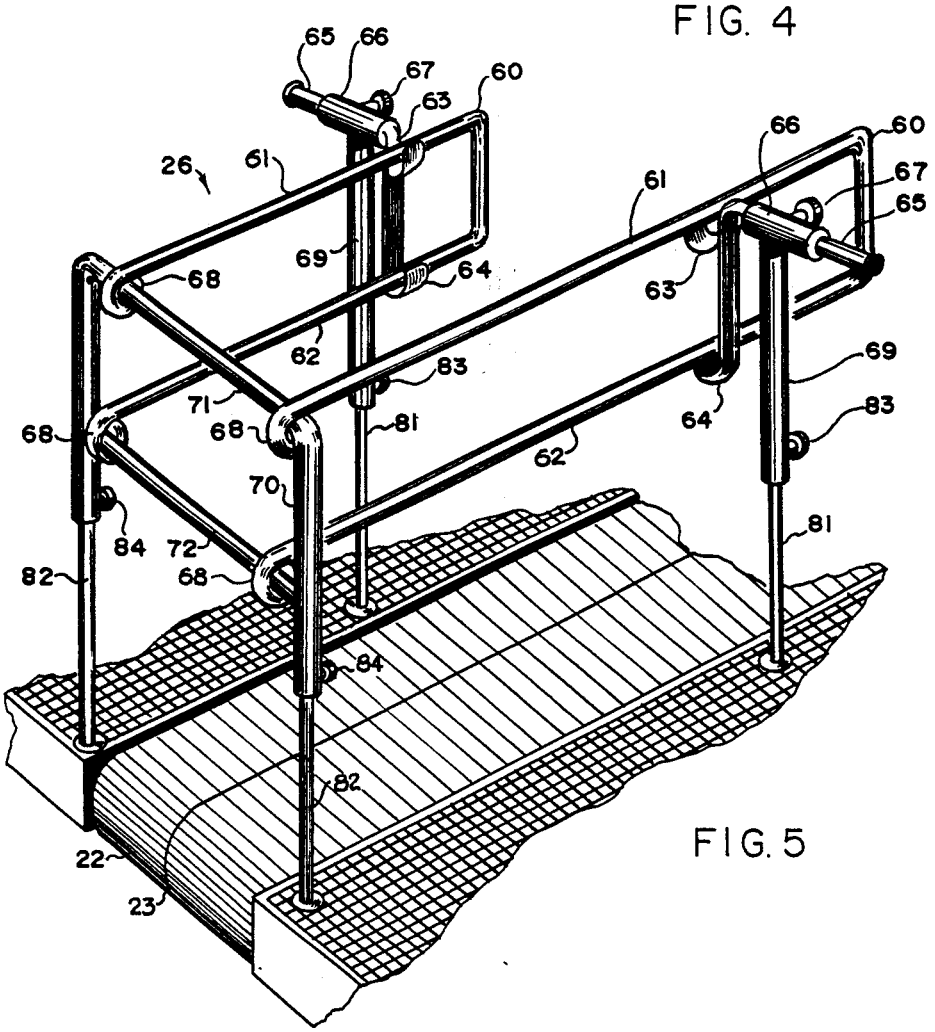
FIG. 5 is a perspective view of a portion of FIG. 1, showing treadmill handrails.

Platform 20 comprises a deck 21, preferably having non-slip grating, which provides a strong, lightweight floor; also, the use of grating facilities the movement of platform 20 through an air/water interface because the grating offers little resistance to the vertical flow of water therethrough. An exercise device, which in the preferred embodiment of the invention comprises a variable resistance, variable angle-of-inclination treadmill 22, is disposed in platform 20. Treadmill control-indicator means 28 allows a user to control the resistance and the angle of incline of the treadmill, it is connected to means (of standard design, not shown in the drawings), within the platform to vary the resistance and the angle of inclination of the treadmill, and has a speedometer means and odometer means to allow the user to observe the speed at which he is exercising and the amount of exercise he has done, respectively. The surface of treadmill 22 on opposite sides of center line 23 may optionally be painted different colors, or otherwise be made visually distinguishable, to aid an exerciser in coordinating the movement of his feet, as will be described further. Handrails 24 are provided on platform 20 to prevent an exerciser's wheelchair from accidentally rolling off of platform 20 and to help prevent an attendant or therapist from falling off of platform 20; a gate 25 allows an exerciser access to the body of water from platform 20. Handrails 26 around treadmill 22 are preferably vertically adjustable, and the spacing between the parallel horizontal portions of handrails 26 may be made variable; handrails 26 assist the exerciser in maintaining himself in an upright position while exercising. Treadmill handrails 26 (FIG. 1) can be seen more clearly in FIG. 5, and comprise a pair of parallel, laterally spaced apart rail members 60, each having an upper rail 60 and a lower rail 62 supported adjacent one end thereof by U-shaped supports 63 and J-shaped supports 64, respectively. Supports 63 and 64 are carried by width-adjustment bars 65, which are slidingly received in horizontal tubes 66. Securers 67 serve to fix the lateral separation of rail members 60, and may comprise, for example, spring-loaded pins which fit in holes (not shown) in width-adjustment bars 65. The ends of rails 61 and 62 opposite width-adjustment bars 65 are slidingly disposed on upper rail 71 and lower rail 72, respectively, of end rail member 70, and are attached thereto by means of hook members 68. Horizontal tubes 66 are disposed at the upper end of vertical support members 69, which are slidingly received on vertical bars 81. End rail member 70 is slidingly received on vertical bars 82. Securers 83 and 84, similar in design and purpose to securers 67, are disposed in vertical support members 69 and end rail member 70, respectively. Deck 21 is preferably made large enough to provide a surface 27 adjacent treadmill 22 on which a therapist or attendant may stand to monitor an exerciser's activities.

Figure 4:
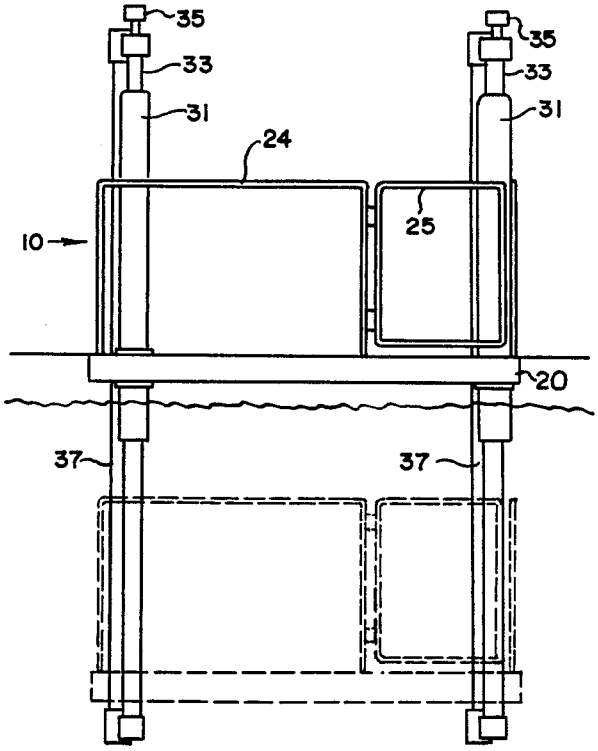
FIG. 4 is a front view of the apparatus shown in FIGS. 1–3.

In operation in a swimming pool, portable aquatic exercise apparatus 10 is placed adjacent an edge 2 of the pool such that L-shaped bars 41 rest on the edge 2 of the pool, non-skid members 45 rest on a deck 5 adjacent the pool, and suction cups 39 are attached to a wall 4 of the pool. Hoses (not shown) are attached to hose couplings 35 in vertical piston members 33 to provide the hydraulic fluid used to raise and lower platform 20 by raising and lowering cylinders 31. The hydraulic fluid (water, preferably) flows through the interior of each vertical piston member 33 and, via opening 53 in vertical piston member 33, into variable-volume fluid-receiving region 51. The water pushes up annular disk 47, and therefore cylinder 31 and platform 20, until platform 20 rises vertically from the position indicated in phantom in FIGS. 1, 2 and 4 to a position in which deck 21 is sufficiently laterally aligned with deck 5 of the swimming pool. The lateral separation of rail members 60 (FIG. 5) is adjusted to afford a comfortable position for handgripping by an exerciser (not shown) by engaging securers 67 in appropriate holes (not shown) in width-adjustment bars 65, and the height of rail members 60 is adjusted to conform to the stature of the exerciser by engaging securers 83 and 84 in appropriate holes (not shown) in vertical bars 81 and 82, respectively. The exerciser wheels onto platform 20 in his wheelchair and hydraulic fluid is allowed to exit variable-volume fluid-receiving region 51, lowering platform 20 into the water. When the desired level is reached such that enough buoyant support is provided by the water, downward movement of platform 20 is stopped. The exerciser exits his wheelchair, stands on treadmill 22 gripping handrails 26 and begins exercising. A therapist (not shown) standing on surface 27 of deck 21 may monitor the exerciser's activity; the two visually- distinguishable areas of the surface of treadmill 22 on opposite sides of the line 23 allow the therapist to observe the exerciser's gait, and help the exerciser coordinate the motion of his feet in a straight line. When the exerciser is finished exercising on the treadmill, he may exit platform 20 via gate 25 for a swimming session in the pool, or he may get back into his wheelchair, raise platform 20 such that deck 21 of platform 20 is adjacent deck 5 of the pool, and exit platform 20 onto deck 5. The exercise sessions are repeated, and if the exerciser develops strength in and/or control of his legs, he exercises with platform 20 at progressively higher levels until his legs can support his weight out of the water.

The aquatic exercise apparatus of the present invention is not limited to use by persons in wheelchairs. Person on crutches, athletes who are susceptible to stress fractures, and even healthy persons with no known physical ailments can find the use of aquatic exercise apparatus 10 a good way to get helpful exercise while limiting the subjection of their joints to weight-induced trauma. For an obese person, aquatic exercise apparatus 10 allows a means to exercise without exhausting himself. Aquatic exercise apparatus 10 is advantageous not only in that it allows an exerciser easy access to a body of water, but also provides him with a variety of means for reducing the pressure on his legs and varying the level of difficulty of an exercise session.

Aquatic exercise apparatus 10 can be used at home, in a clinic, or in pools at universities. Persons with a temporary disability could rent the apparatus from a rental company.

While a single preferred embodiment of the aquatic exercise apparatus of the present invention has been described herein, there are numerous modifications which could be made thereto without departing from the spirit or scope of the present invention. For example, a stationary cycle, a rowing machine, a plurality of rollers, or some other type of stationary exercise device could replace the treadmill. Also, the support system could be modified such that suction cups 39 would no longer be necessary. Although the operation of aquatic exercise apparatus 10 has been described in conjunction with a swimming pool, it can also be mounted on a wharf or pier adjacent the edge of a pond, lake, river, or ocean in which cases an auxiliary pump could be provided to pressurize hydraulic fluid. Also, hydraulic operation could be foregone in favor of electrical operation, for example. In view of these and other modifications to and uses of the preferred embodiment herein described, I pray that my rights to the present invention be limited only by the following claims.

I claim:

1. An aquatic exercise apparatus comprising:
a platform means;
vertical-movement means for vertically moving said platform means between a first position above a body of water, and a second position in which at least a portion of said platform means is disposed in a body of water;
means for mounting said aquatic exercise apparatus adjacent a body of water; and
a stationary exercise device positioned on said platform means.

2. The aquatic exercise apparatus of claim 1, wherein said platform means is of sufficient size to allow a wheelchair to move thereon.

3. An aquatic exercise apparatus comprising:
a platform means;
vertical-movement means for vertically moving said platform means between a first position above a body of water, and a second position in which at least a portion of said platform means is disposed in a body of water;
means for mounting said aquatic exercise apparatus adjacent a body of water; and
an exercise device positioned on said platform means, said exercise device comprising treadmill means.

4. The aquatic exercise apparatus of claim 3, wherein said treadmill means has longitudinal axis and a movable surface, and further comprising means to make two areas of said movable surface visually distinguishable, said two areas being on opposite sides of a line parallel to said longitudinal axis, said line being centered between two edges of said treadmill means.

5. The aquatic exercise apparatus of claim 1, wherein an area is provided on said platform means adjacent said exercise device to allow a therapist to stand on said platform means and monitor an exerciser's activity.

6. The aquatic exercise apparatus of claim 1, further comprising first handrail means adjacent said exercise device.

7. An aquatic exercise apparatus comprising:

a platform means;

vertical-movement means for vertically moving said platform means between a first position above a body of water, and a second position in which at least a portion of said platform means is disposed in a body of water;

means for mounting said aquatic exercise apparatus adjacent a body of water;

an exercise device positioned on said platform means;

first handrail means adjacent said exercise device; and means to vertically adjust said first handrail means relative to said platform means, and wherein said first handrail means comprises two handrail members disposed adjacent opposite edges of said exercise device, and further comprising means to vary lateral separation of said two handrail members.

8. The aquatic exercise apparatus of claim 1, further comprising handrail means adjacent edges of said platform means.

9. An aquatic exercise apparatus comprising:

a platform means;

vertical-movement means for vertically moving said platform means between a first position above a body of water, and a second position in which at least a portion of said platform means is disposed in a body of water means for mounting said aquatic exercise apparatus adjacent a body of water;

an exercise device positioned on said platform means;

handrail means adjacent edges of said platform means; and a gate means adjacent an edge of said platform means.

10. The aquatic exercise apparatus of claim 1, wherein said vertical-movement means is hydraulically operated.

11. The aquatic exercise apparatus of claim 10, wherein hydraulic fluid used to hydraulically operate said vertical movement means comprises water.

12. A portable aquatic exercise apparatus, comprising:

a platform means;

vertical-movement means for vertically moving said platform means between a first position above a body of water, and a second position in which at least a portion of said platform means is disposed in a body of water;

means for securing said portable aquatic exercise apparatus adjacent a body of water;

a stationary exercise device disposed on said platform means; and first handrail means disposed adjacent edges of said platform means.

13. The portable aquatic exercise apparatus of claim 12, wherein said vertical-movement means is hydraulically operated.

14. A portable aquatic exercise apparatus, comprising:

a platform means;

vertical-movement means for vertically moving said platform means between a first position above a body of water, and a second position in which at least a portion of said platform means is disposed in a body of water;

means for securing said portable aquatic exercise apparatus adjacent a body of water;

an exercise device disposed on said platform means; and first handrail means disposed adjacent edges of said platform means, wherein said vertical-movement means is hydraulically operated, said exercise device comprises a treadmill means, and said portable aquatic exercise apparatus further comprises second handrail means adjacent edges of said treadmill means.

15. The portable aquatic exercise apparatus of claim 14, further comprising a gate means adjacent an edge of said platform means.

16. A portable aquatic exercise apparatus, comprising:

a platform means having a treadmill means disposed therein, said platform means being of sufficient size to allow a wheelchair to move thereon and further comprising an area adjacent said treadmill means which is of sufficient size to allow a therapist to stand thereon;

hydraulically-operated vertical-movement means for vertically moving said platform means between a first position above a body of water, and a second position in which at least a portion of said platform means is disposed in a body of water;

means for securing said portable aquatic exercise apparatus adjacent a body of water;

first handrail means disposed adjacent edges of said platform means; and second handrail means disposed adjacent edges of said treadmill means.

17. The portable aquatic exercise apparatus of claim 16, further comprising:

means to vertically adjust said second handrail means relative to said platform means, and wherein said second handrail means comprises two handrail members disposed adjacent opposite edges of said treadmill means, and further comprising means to vary lateral separation of said two handrail members.

18. The portable aquatic exercise apparatus of claim 16, further comprising a gate means adjacent an edge of said platform means.

* * * * *